US007132595B2

(12) United States Patent
Lu et al.

(10) Patent No.: US 7,132,595 B2
(45) Date of Patent: Nov. 7, 2006

(54) BEAT ANALYSIS OF MUSICAL SIGNALS

(75) Inventors: Lie Lu, Beijing (CN); Hong-Jiang Zhang, Beijing (CN)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/264,326

(22) Filed: Nov. 1, 2005

(65) Prior Publication Data

US 2006/0060067 A1 Mar. 23, 2006

Related U.S. Application Data

(63) Continuation of application No. 10/811,287, filed on Mar. 25, 2004, now Pat. No. 7,026,536.

(51) Int. Cl.
*G10H 7/00* (2006.01)

(52) U.S. Cl. ..... 84/612

(58) Field of Classification Search ..... 84/612, 84/636, 652, 668
See application file for complete search history.

(56) References Cited

U.S. PATENT DOCUMENTS

| | | | |
|---|---|---|---|
| 5,616,876 | A | 4/1997 | Cluts |
| 6,153,821 | A | 11/2000 | Fay et al. |
| 6,316,712 | B1 | 11/2001 | Laroche |
| 6,545,209 | B1 | 4/2003 | Flannery et al. |
| 6,657,117 | B1 | 12/2003 | Weare et al. |
| 6,787,689 | B1 | 9/2004 | Chen |
| 2002/0148347 | A1 | 10/2002 | Herberger |
| 2005/0120868 | A1 | 6/2005 | Hinman |

OTHER PUBLICATIONS

Alghoniemy, et al., "Rhythm and Peridicity Detection in Polyphonic Music." 1999 IEEE Third Workshop on Multimedia Signal Processing, Sep. 13-15, 1999, Copenhagen, Denmark, pp. 185-190.
Dixon, et al.: "Real Time Tracking and Visualisation of Musical Expression,"; Music and Artificial Intelligence, 2nd Int'l. Conference, ICAMAL 2002, Proceedings, (Lecture Notes in Artificial Intelligence vol. 2445) Sep. 12-14, 2002, Edinburgh, UK, pp. 58-68.
Cemgil, et al.; "MOnte Carlo Methods for Tempo Tracking and Rhythm Quantization," Journal of Artificial Intelligence Research, vol. 18, 2003, pp. 45-81.
Laroche, "Efficient Tempo and Beat Tracking in Audio Recordings," Journal of the Audio Engineering Society, vol. 51, No. 4, Apr. 2003, pp. 226-233.
Sethares, et al., "Meter and Periodicity in Musical Performance," Jorunal of New Music Research, 2001, vol. 30, No. 2, pp. 149-158.
Kirovski, et al., "Beat-ID: Identifying Music via Beat Analysis," Proceedings of 2002 IEEE Workshop on Multimedia Signal Processing, Dec. 9-11, 2002, St. Thomas, VI, USA, pp. 190-193.
Tzanetakis, et al., "Human Perception and Computer Extraction of Musical Beat Strength," 5th Int'l. Conference on Digital Audio Effects (DAFx-02), Hamburg, Germany, Sep. 26-28, 2002, pp. 257-261.
Tzanetakis, et al., "Musical Genre Classification of Audio Signals," IEEE Transactions on Speech and Audio Processing, vol. 10, No. 5, Jul. 2002, pp. 293-302.

*Primary Examiner*—Jeffrey W Donels
(74) *Attorney, Agent, or Firm*—Lee & Hayes, PLLC

(57) ABSTRACT

A system that analyzes music to detect musical beats and to rectify beats that are out of sync with the actual beat phase of the music. The music analysis includes onset detection, tempo/meter estimation, and beat analysis, which includes the rectification of out-of-sync beats.

17 Claims, 8 Drawing Sheets

BEAT ANALYSIS OF MUSICAL SIGNALS

RELATED APPLICATIONS

This continuation application claims priority to U.S. patent application Ser. No. 10/811,287 to Lie Lu et al., filed Mar. 25, 2004, now U.S. Pat. No. 7,026,536 entitled, "Beat Analysis of Music Signals."

TECHNICAL FIELD

The present patent application disclosure relates to analyzing music, and more particularly, to analyzing the tempo and beat of music.

BACKGROUND

Tempo and beat analysis is the basis of rhythm perception and music understanding. Although most humans can easily follow the beat of music by tapping their feet or clapping their hands, detecting a musical beat automatically remains a difficult task.

Various media editing and playback tools utilize automatic beat detection. For example, currently available movie editing tools permit a user to extract important video shots from a movie and to align transitions between these shots with the beat of a piece of music. Various photo viewing and presentation tools allow a user to put together a slideshow of photos set to music. Some of these photo presentation tools can align the transition between photos in the slideshow with the beat of the music. Other music playback media tools provide visualizations on a computer screen while playing back music. Music visualizations can be any sort of visual design such as circles, lines, flames, fountains, smoke, etc., that change in appearance while music is being played back. Transitions in the appearance of a music visualization that are linked to the beat of the music provide a more interesting experience for the user than if such transitions occur randomly.

The burgeoning use of computers to store, access, edit and playback various media through such media tools makes the task of music beat analysis and detection increasingly important. Accurate and efficient beat analysis and detection algorithms are therefore becoming basic components for various media editing and playback tools that perform tasks such as those mentioned above. However, prior methods and systems of beat analysis and detection have several disadvantages. One disadvantage is that most prior beat analysis and detection methods require that assumptions be made about the time signature and hierarchical meter of the music. For example, a typical assumption made in prior methods is that the time signature of the music is 4/4. Another disadvantage with prior methods/systems is that not all of the detected beats in such systems are in sync with the actual beat phase of the music. Often, there are detected beats that are out of sync or locked in a false beat phase. Furthermore, prior methods and systems do not offer a way to rectify the beats that are out of sync with the true beat phase of the music.

Accordingly, a need exists for improved beat analysis and detection that does not require assumptions regarding musical time signature and hierarchical meter, and that overcomes various disadvantages with prior methods such as those mentioned above.

SUMMARY

A system and methods analyze music to detect musical beats and to rectify beats that are out of sync with the actual beat phase of the music. The music analysis includes onset detection, tempo/meter estimation, and beat analysis, which includes the rectification of out-of-sync beats.

BRIEF DESCRIPTION OF THE DRAWINGS

The same reference numerals are used throughout the drawings to reference like components and features.

DETAILED DESCRIPTION

Overview

The following discussion is directed to a system that analyzes music to detect the beat of the music. Advantages of this system include an improved approach to beat detection that does not require an assumption of the musical time signature or hierarchical meter. Another advantage is a process for rectifying out-of-sync beats based on tempo consistency across the whole musical excerpt.

Exemplary Environment

Figure 1:
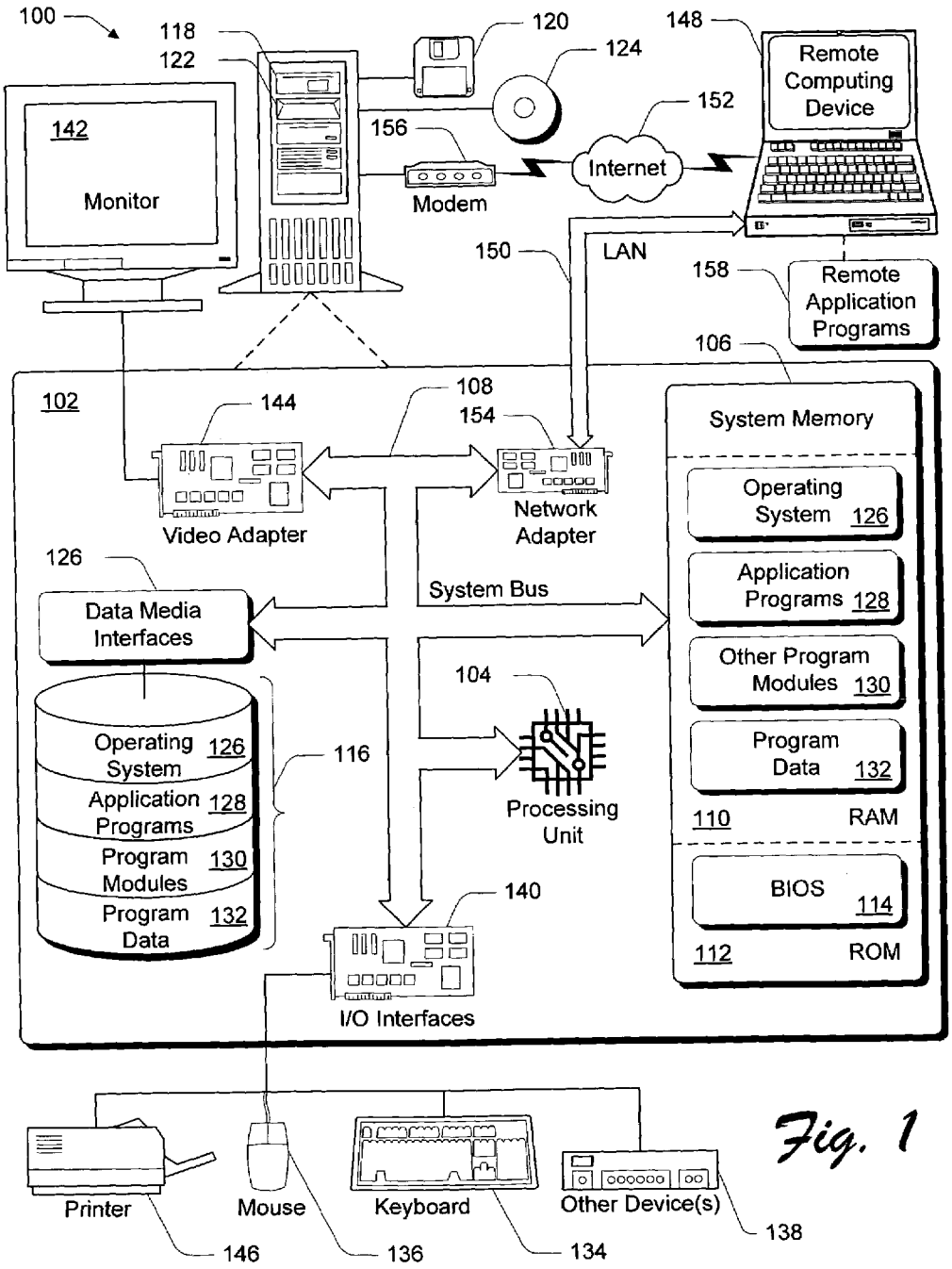
FIG. 1 illustrates an exemplary environment suitable for implementing beat analysis and detection in music.

FIG. 1 illustrates an exemplary computing environment 100 suitable for beat analysis and detection in music. Although one specific computing configuration is shown in FIG. 1, various computers may be implemented in other computing configurations that are suitable for performing beat analysis and detection.

The computing environment 100 includes a general-purpose computing system in the form of a computer 102. The components of computer 102 may include, but are not limited to, one or more processors or processing units 104, a system memory 106, and a system bus 108 that couples various system components including the processor 104 to the system memory 106.

The system bus 108 represents one or more of any of several types of bus structures, including a memory bus or memory controller, a peripheral bus, an accelerated graphics port, and a processor or local bus using any of a variety of bus architectures. An example of a system bus 108 would be a Peripheral Component Interconnects (PCI) bus, also known as a Mezzanine bus.

Computer 102 includes a variety of computer-readable media. Such media can be any available media that is accessible by computer 102 and includes both volatile and non-volatile media, removable and non-removable media. The system memory 106 includes computer readable media in the form of volatile memory, such as random access memory (RAM) 110, and/or non-volatile memory, such as read only memory (ROM) 112. A basic input/output system (BIOS) 114, containing the basic routines that help to transfer information between elements within computer 102, such as during start-up, is stored in ROM 112. RAM 110 contains data and/or program modules that are immediately accessible to and/or presently operated on by the processing unit 104.

Computer 102 may also include other removable/non-removable, volatile/non-volatile computer storage media. By way of example, FIG. 1 illustrates a hard disk drive 116 for reading from and writing to a non-removable, non-volatile magnetic media (not shown), a magnetic disk drive 118 for reading from and writing to a removable, non-volatile magnetic disk 120 (e.g., a "floppy disk"), and an optical disk drive 122 for reading from and/or writing to a removable, non-volatile optical disk 124 such as a CD-ROM, DVD-ROM, or other optical media. The hard disk drive 116, magnetic disk drive 118, and optical disk drive 122 are each connected to the system bus 108 by one or more data media interfaces 126. Alternatively, the hard disk drive 116, magnetic disk drive 118, and optical disk drive 122 may be connected to the system bus 108 by a SCSI interface (not shown).

The disk drives and their associated computer-readable media provide non-volatile storage of computer readable instructions, data structures, program modules, and other data for computer 102. Although the example illustrates a hard disk 116, a removable magnetic disk 120, and a removable optical disk 124, it is to be appreciated that other types of computer readable media which can store data that is accessible by a computer, such as magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like, can also be utilized to implement the exemplary computing system and environment.

Any number of program modules can be stored on the hard disk 116, magnetic disk 120, optical disk 124, ROM 112, and/or RAM 110, including by way of example, an operating system 126, one or more application programs 128, other program modules 130, and program data 132. Each of such operating system 126, one or more application programs 128, other program modules 130, and program data 132 (or some combination thereof) may include an embodiment of a caching scheme for user network access information.

Computer 102 can include a variety of computer/processor readable media identified as communication media. Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

A user can enter commands and information into computer system 102 via input devices such as a keyboard 134 and a pointing device 136 (e.g., a "mouse"). Other input devices 138 (not shown specifically) may include a microphone, joystick, game pad, satellite dish, serial port, scanner, and/or the like. These and other input devices are connected to the processing unit 104 via input/output interfaces 140 that are coupled to the system bus 108, but may be connected by other interface and bus structures, such as a parallel port, game port, or a universal serial bus (USB).

A monitor 142 or other type of display device may also be connected to the system bus 108 via an interface, such as a video adapter 144. In addition to the monitor 142, other output peripheral devices may include components such as speakers (not shown) and a printer 146 which can be connected to computer 102 via the input/output interfaces 140.

Computer 102 may operate in a networked environment using logical connections to one or more remote computers, such as a remote computing device 148. By way of example, the remote computing device 148 can be a personal computer, portable computer, a server, a router, a network computer, a peer device or other common network node, and the like. The remote computing device 148 is illustrated as a portable computer that may include many or all of the elements and features described herein relative to computer system 102.

Logical connections between computer 102 and the remote computer 148 are depicted as a local area network (LAN) 150 and a general wide area network (WAN) 152. Such networking environments are commonplace in offices, enterprise-wide computer networks, intranets, and the Internet. When implemented in a LAN networking environment, the computer 102 is connected to a local network 150 via a network interface or adapter 154. When implemented in a WAN networking environment, the computer 102 includes a modem 156 or other means for establishing communications over the wide network 152. The modem 156, which can be internal or external to computer 102, can be connected to the system bus 108 via the input/output interfaces 140 or other appropriate mechanisms. It is to be appreciated that the illustrated network connections are exemplary and that other means of establishing communication link(s) between the computers 102 and 148 can be employed.

In a networked environment, such as that illustrated with computing environment 100, program modules depicted relative to the computer 102, or portions thereof, may be stored in a remote memory storage device. By way of example, remote application programs 158 reside on a memory device of remote computer 148. For purposes of illustration, application programs and other executable program components, such as the operating system, are illustrated herein as discrete blocks, although it is recognized that such programs and components reside at various times in different storage components of the computer system 102, and are executed by the data processor(s) of the computer.

Exemplary Embodiments

Figure 2:
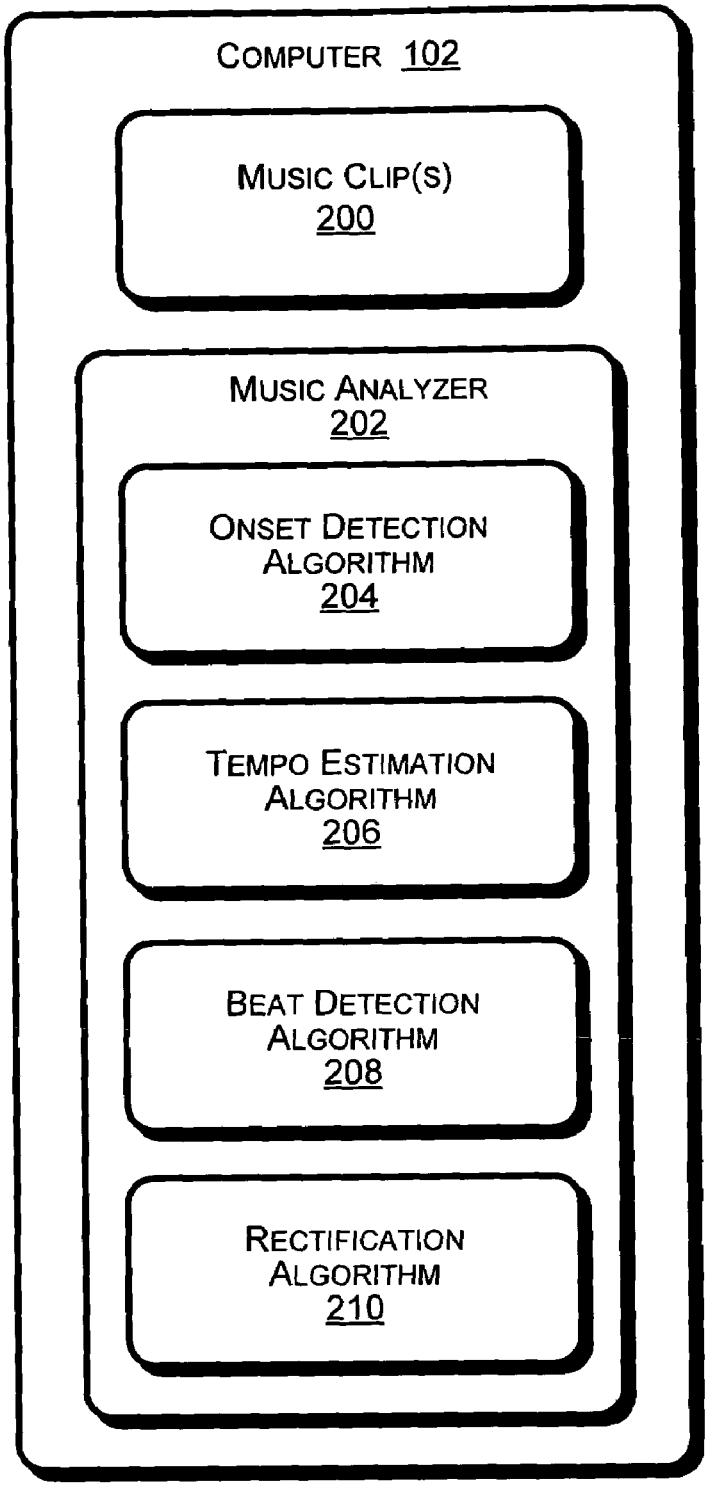
FIG. 2 illustrates a block diagram representation of an exemplary computer showing exemplary components suitable for facilitating beat analysis and detection in a music clip or excerpt.

FIG. 2 is a block diagram representation of an exemplary computer 102 illustrating exemplary components suitable for facilitating beat analysis and detection in a music clip or excerpt. Computer 102 includes one or more music clips 200 formatted as any of variously formatted music files including, for example, MP3 (MPEG-1 Audio Layer 3) files or WMA (Windows Media Audio) files. Computer 102 also includes a music analyzer 202 generally configured to detect music onsets, estimate music tempo, analyze and detect musical beats, and rectify out-of-sync beats. Accordingly, the music analyzer 202 includes onset detection algorithm 204, tempo estimation algorithm 206, beat detection algorithm 208, and rectification algorithm 210. It is noted that these components (i.e., music analyzer 202, onset detection algorithm 204, tempo estimation algorithm 206, beat detection algorithm 208, and rectification algorithm 210) are shown in FIG. 2 by way of example only, and not by way of limitation. Their illustration in the manner shown in FIG. 2 is intended to facilitate discussion of beat analysis and detection of a music clip on a computer 102. Thus, it is to be understood that various configurations are possible regarding the functions performed by these components as described herein below. For example, such components might be separate stand alone components or they might be combined as a single component on computer 102.

The music analyzer 202, its components, and their respective functions can be briefly described as follows. In general, the music analyzer 202 detects onsets in a music clip using onset detection algorithm 204. An onset is the beginning of a musical sound where the energy usually has a big variance. For example, an onset may be the time when a piano key is pressed down. As discussed below, onsets are usually detected as local peaks from an onset curve. After detecting onsets in a music clip with onset detection algorithm 204, the music analyzer 202 estimates tempo (or meter) using tempo estimation algorithm 206. Tempo is the period of beats, representing basic recurrent rhythmical pattern in the music. Tempo is estimated based on an auto-correlation of the onset curve of the music clip as discussed below. After tempo estimation algorithm 206 estimates the tempo of the music, the beat detection algorithm 208 detects beat sequences based on the onset curve and estimated tempo of the music. After beat sequences are determined, segments containing continuous beat sequences are used to build a phase tree based on which segments share the same beat phase. The rectification algorithm 210 determines which group of segments contains the largest number of beats and assumes those segments to be in sync with the actual beat phase of the music. Segments that are not part of the group of segments which contains the largest number of beats are segments that are assumed to be out-of-sync with the actual beat phase of the music. These out-of-sync segments are then rectified by following the actual beat phase.

Figure 3:
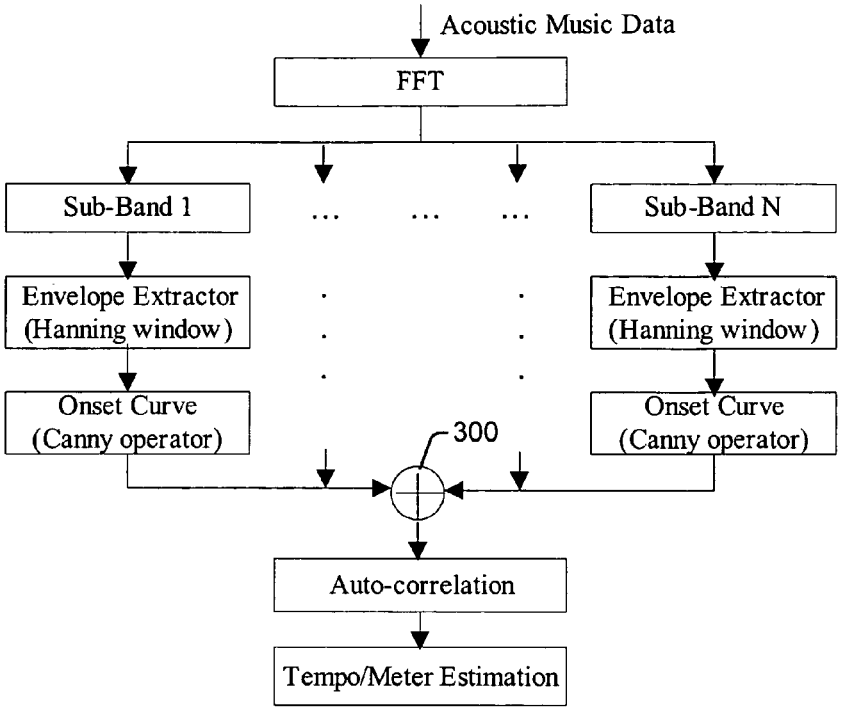
FIG. 3 illustrates a basic process of onset detection and tempo estimation.
Figure 4:
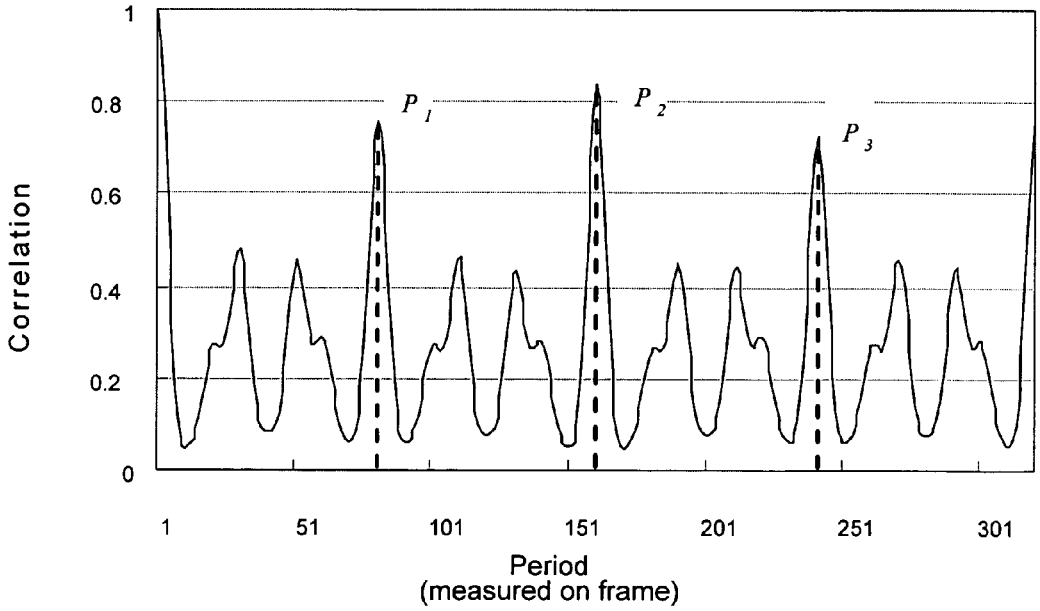
FIG. 4 is an auto-correlation curve that illustrates music that has a ternary meter with the time signature of 3/4.
Figure 5:
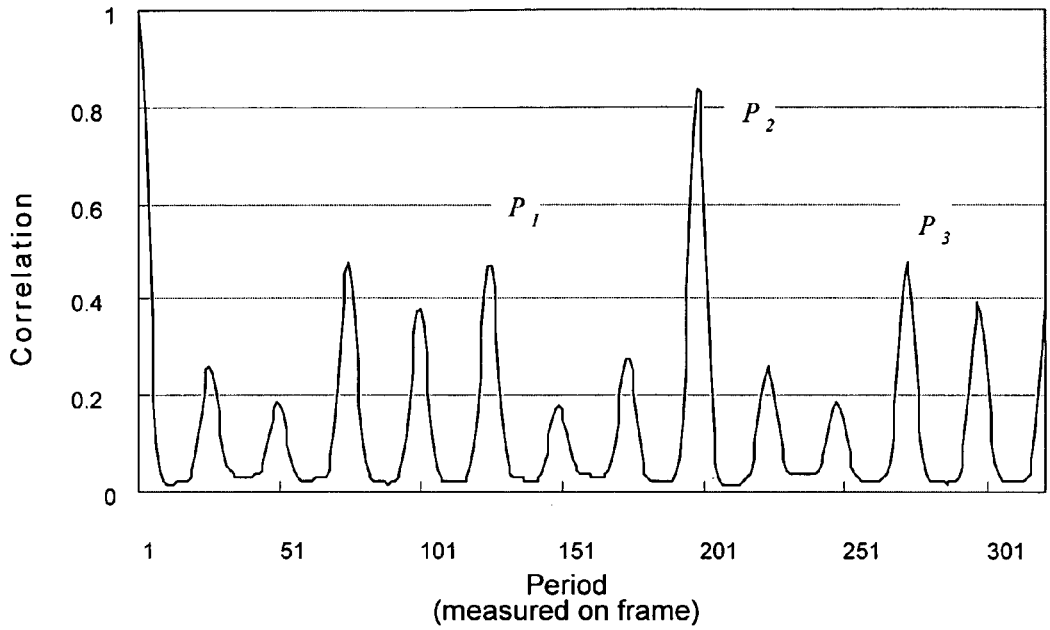
FIG. 5 is an auto-correlation curve that illustrates music that has a binary meter with the time signature of 4/4.

Onset detection and tempo estimation will now be discussed in greater detail with primary reference to FIGS. 3, 4, and 5. The basic process of onset detection and tempo estimation is illustrated in FIG. 3. In order to provide processing of music in different formats, music data from the input music clip 200 is first down-sampled into a uniform format, such as a 16 KHz, 16 bit, mono-channel sample. It is noted that this is only one example of a uniform format that is suitable, and that various other uniform formats may also be used.

After conversion into a uniform format, the data from the music clip is divided into non-overlapping temporal frames, such as 16 microsecond-long frames.

Use of a 16 microsecond frame length is also only an example, and various other non-overlapping frame lengths may also be suitable. The spectrum of each frame is then calculated by FFT (Fast Fourier Transform). Each frame is divided into a number of octave-based sub-bands (Sub-Band 1-Sub-Band N). In this example, each frame is divided into six octave-based sub-bands. The amplitude envelope of each sub-band is then calculated by convolving with a half raise cosine Hanning window. From the amplitude envelope, an onset curve is detected by calculating the variance of the envelope of each sub-band using a Canny operator, that is, $$O_i(n)=A_i(n)C(n) \tag{1}$$

where $O_i(n)$ is the onset curve in the i-th sub-band, $A_i(n)$ is the amplitude envelope of the i-th sub-band and C(n) is the Canny operator with a Gaussian kernel, $$C(n) = \frac{i}{\sigma^2} e^{-i^2/2\sigma^2} \quad n \in [-L_c, L_c] \tag{2}$$

where Lc is the length of Canny operator and the σ is used to control the operator's shape. In a preferred implementation, Lc and σ are set as 12 and 4, respectively. Use of the Canny operator, rather than a one-order difference, has the potential of finding more onsets that have slopes with gradual transitions in the energy envelope. A one-order difference can only catch the abrupt changes in the energy envelope. Use of a half Hanning window and a Canny estimator are both well-known processes to those skilled in the art, and they will therefore not be further described.

An onset curve is a sequence of potential onsets along the time line. The onset curve represents the energy variance at each time slot. Onsets are detected as the local peaks from the onset curve. The onsets, or local peaks, represent the local maximum variance of the energy envelope. From the onsets detected from each sub-band, the lowest and the highest sub-bands contain the most obvious, regular and representative beat patterns. This is reasonable since most beats are indicated by low-frequency and high-frequency instrumentals, especially those using bass drum and snare drum in popular music. Considering this fact, only these two sub-bands (i.e., the lowest sub-band and the highest sub-band) are used for tempo estimation and final beat detection. Thus, in the current example implementation where each frame is divided into six octave-based sub-bands, only the first and sixth sub-bands are used for tempo estimation and final beat detection.

Referring still to FIG. 3, to detect tempo and rhythm information, the onset curves of the low sub-band and the high sub-band are summed 300 according to equation (3), $$O(n)=\Sigma O_i(n) \tag{3}$$

where O(n) represents the onset curve of the music.

Auto-correlation is then used to estimate the tempo. Auto-correlation uses memory efficiently and can find subtle meter structure, as demonstrated in the following discussion. Based on all the prominent local peaks of the auto-correlation curve, tempo is estimated as their maximum common divisor, which is also a prominent peak according to equation (4) as follows:

$$T = \arg\min_{P_k} \sum_{i=1}^{N} \left| \frac{P_i}{P_k} - \left[ \frac{P_i}{P_k} + 0.5 \right] \right| \tag{4}$$

where Pk are the prominent local peaks. In a preferred implementation, the prominent local peaks are detected with a threshold 0.1.

The bar length, or measure, represents a higher structure than beat. A bar, or measure, in music, is one of the small equal parts into which a piece of music is divided. It contains a fixed number of beats. In the present embodiment, the bar length is estimated using certain rules based on the first three maximum peaks of the auto-correlation curve as shown, for example, in FIGS. 4 and 5. FIGS. 4 and 5 demonstrate tempo and meter estimation by auto-correlation analysis. In the auto-correlation curves of FIGS. 4 and 5, the X axis is a measure of the period which is taken on frames of music, and the Y axis is a measure of correlation. FIG. 4 illustrates a ternary meter with the time signature of 3/4, while FIG. 5 shows a binary meter with the time signature of 4/4. $P_1$, $P_2$, and $P_3$ represent the first three highest peaks, from left to right in both FIGS. 4 and 5.

The first rule for estimating the bar length is that if the three peaks of the auto-correlation curve are regularly placed along the period, then the maximum common divisor of the three peaks is used as the estimation of the bar length. Otherwise, the position of the maximum peak along the period is used as the estimation for the bar length. The length is finally normalized to an approximate range, by iterative halving or doubling if the corresponding position also has a local peak in the auto-correlation function.

It should be noted that the bar length detected by this method is prone to be a half or double of the truth value. However, it can still indicate a more subtle structure of the meter. For example, if the bar length is three multiples of the tempo, the meter can be classified into "ternary" meter as shown in FIG. 4. Otherwise, the meter is a "binary" meter as shown in FIG. 5. Furthermore, the music can be further assumed as having the time signature of 3/4 or 4/4.

Beat analysis and the rectification of out-of-sync beats will now be discussed in greater detail with primary reference to FIGS. 6, 7, 8, and 9. In general, using beat detection algorithm 208 (FIG. 2), a beat sequence (beat phase) is detected based on the onset curve and estimated tempo discussed above. That is, beat phase is detected after the beat period is obtained. Then, a rectification algorithm 210 rectifies segments where the beat phase is falsely locked, based on the tempo consistency across the whole piece of music.

Figure 6:
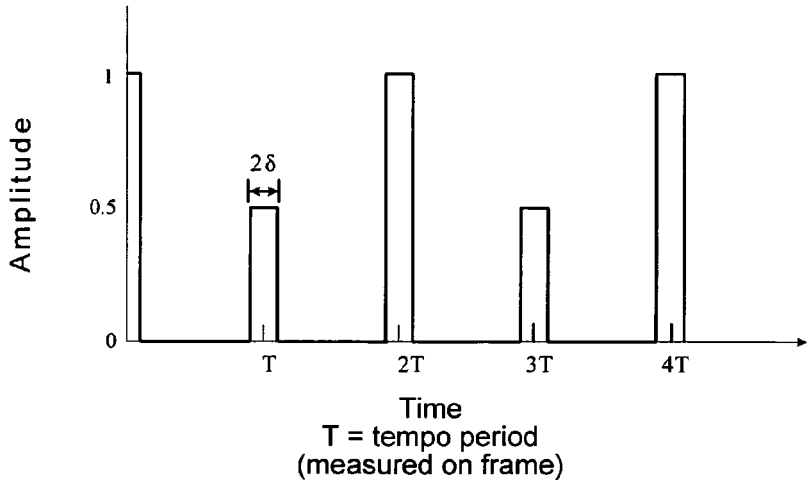
FIG. 6 illustrates an example beat template of a binary meter.

As tempo information is obtained, a beat pattern template is established to calculate the confidence that each onset is a beat candidate in the onset sequence (i.e., onset curve). Recall that onsets are detected as the local peaks from the onset curve and they represent the local maximum variance of the energy envelope of the onset curve. The beat template is designed to represent the rhythm pattern of the music. FIG. 6 illustrates an example beat template of a binary meter, such as the time signature 4/4, where T is the tempo period and δ is tolerance of beat phase deviation. In the FIG. 6 example, the beat phase deviation is set as 5% of the tempo T. The illustrated beat pattern template is characterized by four regularly placed beats which conform to a rhythm pattern such as "strong-weak-strong-weak". A corresponding beat pattern template could also be designed to represent music with a ternary meter or a time signature of 3/4.

The beat confidence of each onset is calculated by matching the beat pattern template along the onset sequence, as $$Conf(n) = \frac{\sum_k O(n+k) P_T(k)}{\sqrt{\sum_k O^2(n+k) \sum_k P_T^2(k)}} \tag{5}$$

where Conf(n) is beat confidence at n-th frame, and $P_T(k)$ is the beat pattern template. Thus, for a given onset, if there also appear onsets at estimated positions having regular intervals of tempo, the confidence is high and the onset is more likely to be a beat. Otherwise, the confidence is low and the onset is less likely to be a beat. A potential beat, or beat candidate, is then detected or determined based on confidence level. When the confidence of an onset is above a certain threshold, the onset is detected as a beat candidate. The threshold is adaptively set based on the following:

$$Th_i = \alpha \cdot \frac{1}{2N} \sum_{n=-N}^{N} Conf(i+n) \tag{6}$$

Figure 7:
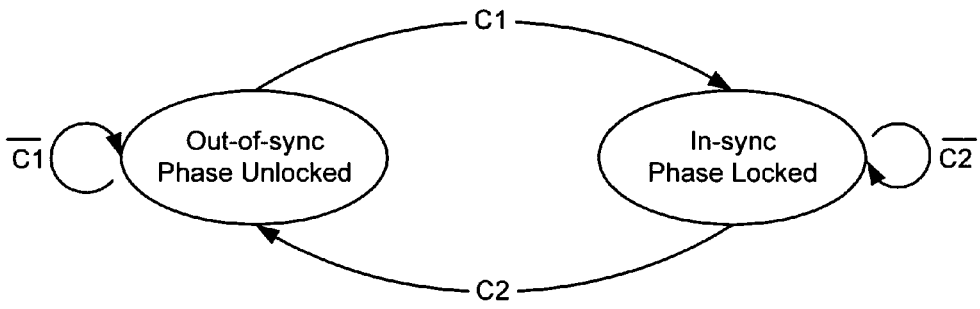
FIG. 7 illustrates an example beat sequence search process that uses a quasi finite state machine.

The beat sequence search process is illustrated in FIG. 7, using a quasi finite state machine. If there are three continuous beat candidates with intervals of one or multiple tempos, these three candidates are confirmed as beats, and the tracking is synchronized and beat phase is locked. If the next beat candidate appears at an estimated beat position that is one or multiple tempos from the previous beat, the tracking is still kept in sync and the missing beats, if there are any, can be restored using the interval of tempo. However, once none of next three beat candidates appear at the estimated beat position (i.e., once three consecutive beat candidates fail to appear at the estimated beat position that is one or multiple tempos from the previous beat), the tracking is out of sync, and a new search for sync begins.

Figure 8:
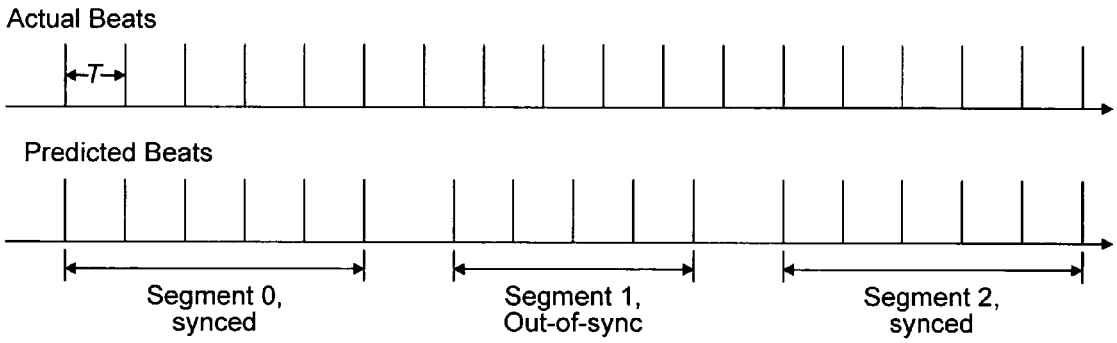
FIG. 8 illustrates example results of a beat search process showing some segments that are out of sync with the actual beat position.

Based on the above tracking process, the beat search alternates between being in a state of sync and out-of-sync. Thus, final results may contain several independent segments of beats where each segment contains a continuous beat sequence with the interval of the tempo period, but where two contiguous beat segments are not at the interval of multiple tempos. This means that some of segments may be out of sync with the actual beat position, i.e., falsely locked on the wrong beat phase. An example of such a beat search result is demonstrated in FIG. 8. As shown in FIG. 8, the beat detection result is only half-synced.

FIG. 8 shows that segment 0 and segment 2 are apart by the interval of multiple tempos. Segments 0 and 2 are synced with the actual beat and share the same beat phase. However, segment 1 is out-of-sync with the actual beat and does not share the same beat phase with segments 0 and 2. Given such results, the out-of-sync beat segment 1 can be rectified by making it follow the same beat phase that segments 0 and 2 follow. Therefore, in order to rectify out-of-sync segments, it is first determined which segments are synced with the actual beat phase and which segments are out-of-sync with the actual beat phase.

The rectification algorithm 210 determines which segments are synced with the actual beat phase and which segments are out-of-sync with the actual beat phase by first looking for those segments which share the same beat phase.

The rectification algorithm 210 assumes that most of the detected beats are correctly phase-locked. Therefore the group of segments having the largest number of beats can be considered to be properly synced with the actual beat phase. Conversely, those segments not falling in with this group, are segments which are considered to be out-of-sync with the actual beat phase.

Figure 9:
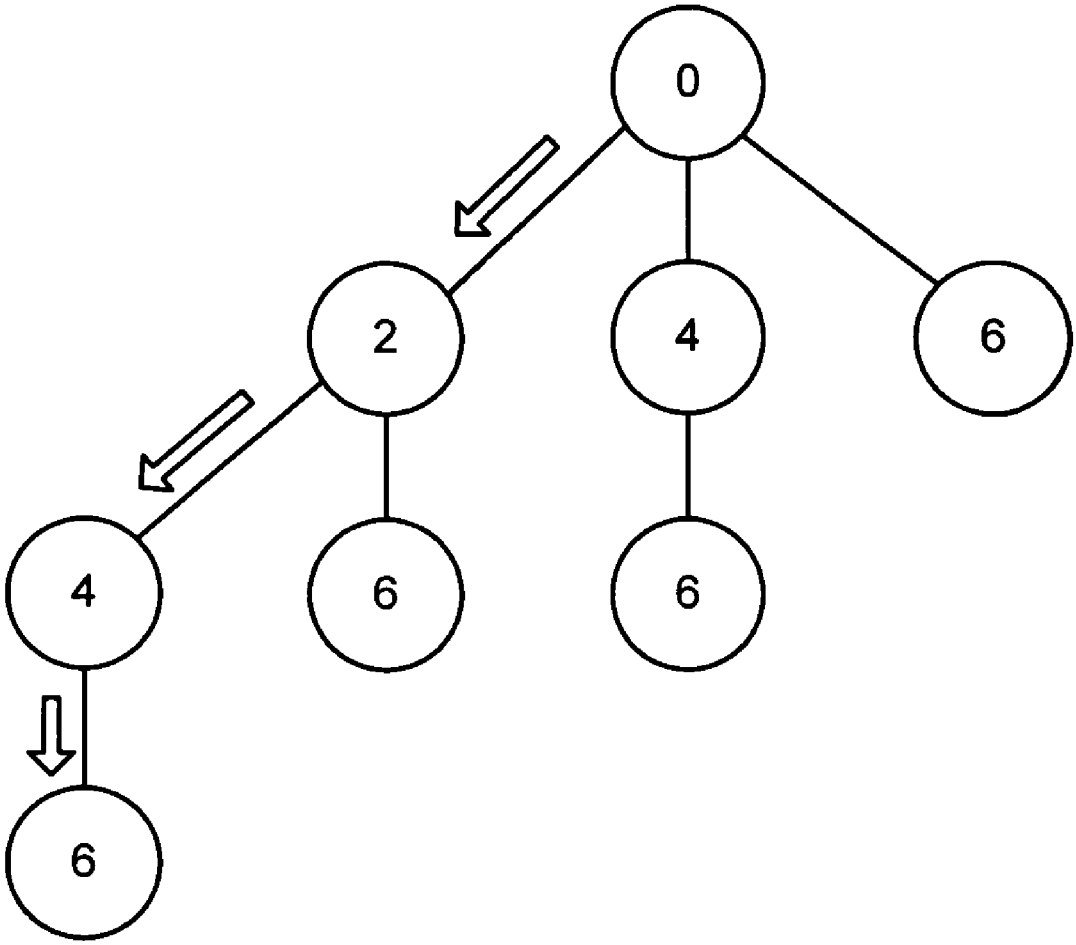
FIG. 9 illustrates an example of a phase tree used to find the largest sequence of beats from segments that share the same beat phase.

In order to find the largest sequence of beats from each segment that share the same beat phase (and thereby finding the highest number of detected beats), rectification algorithm 210 builds a phase tree from each segment. FIG. 9 illustrates an example of a phase tree. The phase tree is established using the following rule: if one segment shares the same phase with one node (or the head), that segment is inserted into the tree as a child of the node. The process is iterated until all the segments are processed. Thus, the largest sequence of beats from each segment can be detected by searching through the corresponding phase trees.

After finding the segment sequence with the largest number of beats, which is assumed to be in sync with the actual beat phase, those segments that are out-of-sync can be easily rectified, just by following the actual beat phases.

As an example, FIG. 9 shows a phase tree which starts from segment 0. Each circle represents a segment where the number in the circle is the segment index and the connection line means that two segments share a same phase. Therefore, starting with segment 0, if segment 2 shares the same beat phase with segment 0, then segment 2 is connected to segment 0 with a line. If segment 4 shares the same beat phase with segments 2 and 0, then segment 4 is also connected to segment 2 and segment 0 with a line. This process continues until all the segments have been processed. Then the largest segment sequence from segment 0 can be detected by searching through the phase tree. Correspondingly, the sequence starting from other segments are also detected. Thus, the largest sequence of segments in a music clip can be detected by comparing all the sequences starting from each segment. In the example of FIG. 9, segments 0, 2, 4, and 6 make up the largest sequence of segments. The rectification algorithm 210 then assumes that this largest sequence of segments is correctly synced with the actual beat phase (actual beats) of the music. Accordingly, segments 1, 3, and 5 are determined to be out-of-sync with the actual beat phase (actual beats) of the music. The out-of-sync segments (1, 3, and 5) can be rectified by making them follow the actual beat phase. This is done by using the beat phase of the synced segments (0, 2, 4, and 6) for the segments that are out-of-sync (i.e., segments 1, 3, and 5).

Exemplary Methods

Figure 10:
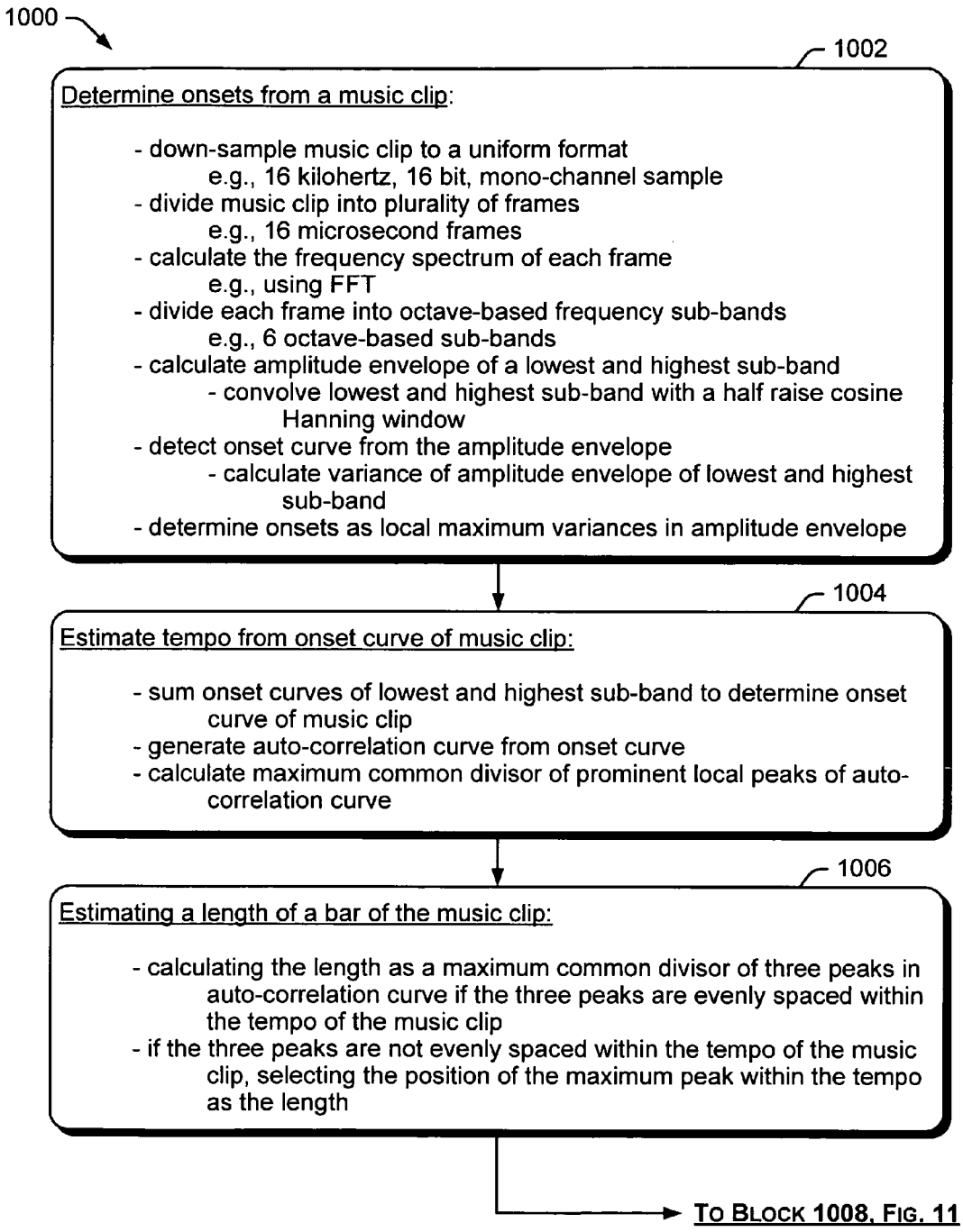
FIG. 10 is a flow diagram illustrating exemplary methods for implementing beat analysis and detection in music.

Example methods for beat analysis and detection in music will now be described with primary reference to the flow diagrams of FIGS. 10 and 11. The methods apply to the exemplary embodiments discussed above with respect to FIGS. 1–9. While one or more methods are disclosed by means of flow diagrams and text associated with the blocks of the flow diagrams, it is to be understood that the elements of the described methods do not necessarily have to be performed in the order in which they are presented, and that alternative orders may result in similar advantages. Furthermore, the methods are not exclusive and can be performed alone or in combination with one another. The elements of the described methods may be performed by any appropriate means including, for example, by hardware logic blocks on an ASIC or by the execution of processor-readable instructions defined on a processor-readable medium.

A "processor-readable medium," as used herein, can be any means that can contain, store, communicate, propagate, or transport instructions for use or execution by a processor. A processor-readable medium can be, without limitation, an electronic, magnetic, optical, electromagnetic, infrared, or semiconductor system, apparatus, device, or propagation medium. More specific examples of a processor-readable medium include, among others, an electrical connection (electronic) having one or more wires, a portable computer diskette (magnetic), a random access memory (RAM) (magnetic), a read-only memory (ROM) (magnetic), an erasable programmable-read-only memory (EPROM or Flash memory), an optical fiber (optical), a rewritable compact disc (CD-RW) (optical), and a portable compact disc read-only memory (CDROM) (optical).

At block 1002 of method 1000, onsets from a music clip are determined. The general process for determining or detecting musical onsets includes various steps. The music clip is first down-sampled to a uniform format such as a 16 kilohertz, 16 bit, mono-channel sample. The music clip is then divided into plurality of frames that are, for example, 16 microseconds in length. The frequency spectrum of each frame is then calculated using FFT (Fast Fourier Transform), and each frame is divided into a number of octave-based frequency sub-bands. In a preferred implementation, frames are divided into 6 octave-based frequency sub-bands. The amplitude envelope of the lowest and the highest sub-bands are calculated by convolving these sub-bands with a half raised, Hanning window. The onset curve is then determined from the amplitude envelope by calculating the variance of the amplitude of the lowest and highest sub-bands. The music onsets can then be determined as the local maximum variances in the amplitude envelope.

At block 1004 of method 1000, the tempo of the music clip is estimated from the onset curve. Estimating the tempo includes summing the onset curves of the lowest and highest sub-bands to first determine the onset curve of the music clip. An auto-correlation curve is then generated from the onset curve of the music clip, and the maximum common divisor of prominent local peaks of the auto-correlation curve is calculated.

At block 1006, the length of a bar (i.e., the length of a measure) of music is estimated. The bar length estimation includes calculating the length as a maximum common divisor of three peaks in the auto-correlation curve if the three peaks are evenly spaced within the tempo of the music clip. However, if the three peaks are not evenly spaced within the tempo of the music clip, the length is selected as the position of the maximum peak within the tempo. The length is finally normalized to an approximate range.

Figure 11:
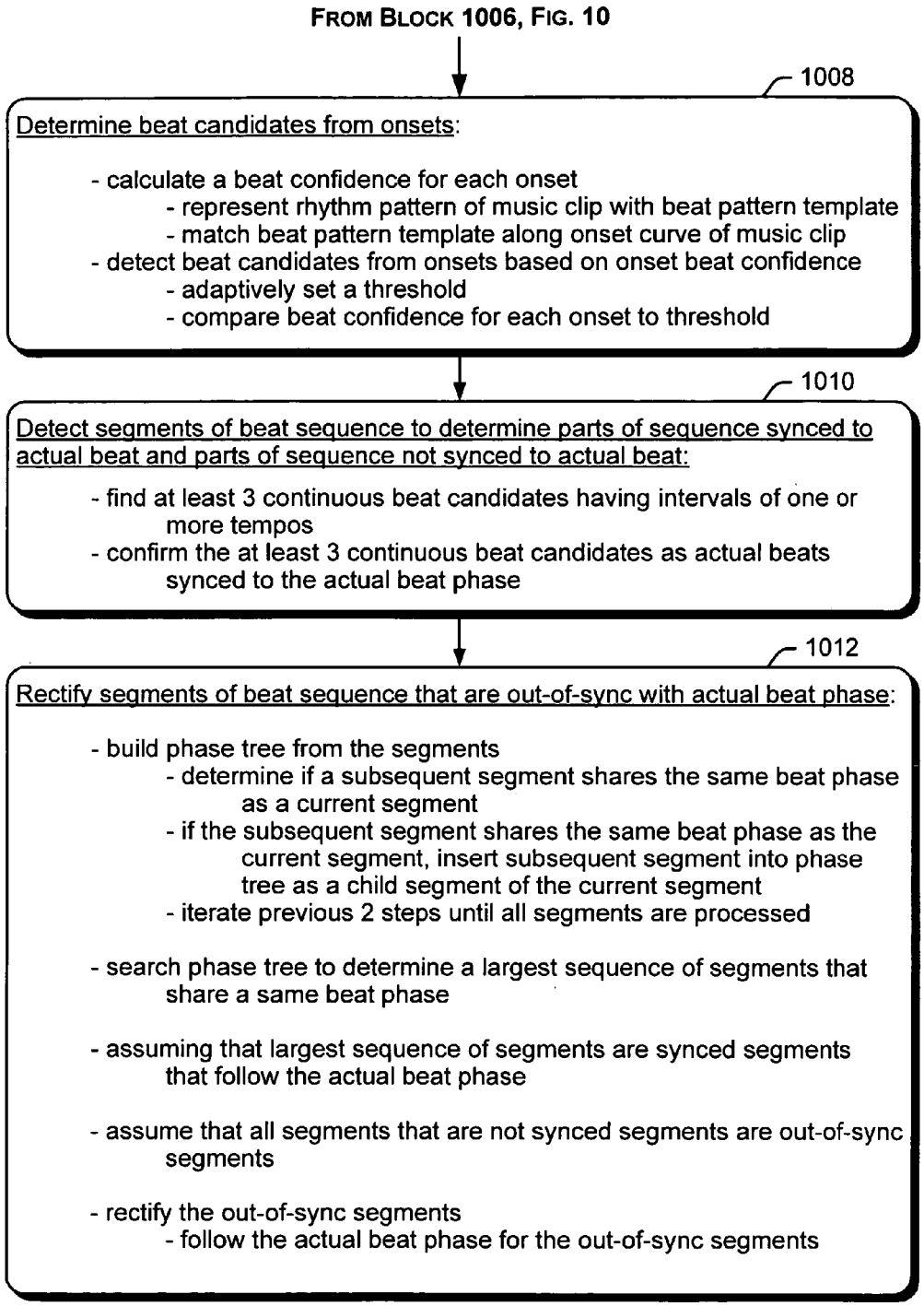
FIG. 11 is a continuation of the flow diagram of FIG. 10 illustrating exemplary methods for implementing beat analysis and detection in music.

The method 1000 continues with block 1008 of FIG. 11. At block 1008 of method 1000, beat candidates are determined from the onsets. Determining beat candidates includes calculating a beat confidence level for each onset and then detecting the beat candidates based on the beat confidence for each onset. To calculate beat confidence, the rhythm pattern of the music clip is represented with a beat pattern template and the beat pattern template is matched along the onset sequence (the onset curve) of the music clip. To detect beat candidates, a threshold is adaptively set as discussed above, and the beat confidence level for each onset is compared to the threshold.

At block 1010 of method 1000, segments of beat sequence are detected in order to determine parts of the beat sequence that are synced with the actual beat and parts that may not be synced with the actual beat. Locking beat phases includes finding at least 3 continuous beat candidates that have intervals of one or more tempos. The 3 continuous beat candidates are then confirmed as beats.

At block 1012 of method 1000, the segments of beat sequences that are found to be out-of-sync with actual beat phase are rectified. Rectification of out-of-sync segments includes building phase trees from all the beat segments and searching through the phase tree for the largest sequence of segments that share the same beat phase. Then, it is assumed that the segments making up this largest sequence of segments are segments that are synced with the actual beat phase. Conversely, it is assumed that all segments that are not synced segments are out-of-sync segments. The out-of-sync segments are then rectified by following the actual beat phase.

Building the phase tree out of beat segments includes determining if a subsequent segment shares the same beat phase as a current segment. If the subsequent segment shares the same beat phase as the current segment, the subsequent segment is inserted into the phase tree as a child segment of the current segment. This process is repeated until all of the beat segments are processed.

Conclusion

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

The invention claimed is:

1. A method, comprising:

determining onsets from a music clip;

estimating tempo from an onset curve of the music clip;

determining beat candidates from the onsets, wherein the determining beat candidates includes calculating a beat confidence for each onset by matching the beat pattern template along the onset sequence as $$Conf(n) = \frac{\sum_k O(n+k)P_T(k)}{\sqrt{\sum_k O^2(n+k)\sum_k P_T^2(k)}}$$

wherein Conf(n) is beat confidence at the n-th frame, and PT(k) is the beat pattern template;

determining from beat candidates, segments of beat sequences that are synced to an actual beat phase, wherein determining segments of beat sequences comprises finding at feast three continuous beat candidates having intervals of one or more tempos and confirming the at least three continuous beat candidates as actual beats synced to the actual beat phase;

rectifying segments of beat sequences that are out-of-sync with the actual beat phase; and wherein the rectifying segments includes building a phase tree from each segment;

searching the phase trees to determine a largest sequence of segments that share a same beat phase;

defining the largest sequence of segments as synced segments that follow the actual beat phase;

defining segments that are not in the largest sequence of segments as out-of-sync segments; and rectifying the out-of-sync segments, wherein rectifying comprises following the actual beat phase for the out-of-sync segments.

2. A method as recited in claim 1, wherein the building comprises determining if a subsequent segment shares the same beat phase as a current segment;

if the subsequent segment shares the same beat phase as the current segment, inserting the subsequent segment into the phase tree as a child segment of the current segment; and iterating the previous two steps until all segments are processed.

3. A method, comprising:

determining onsets from a music clip;

determining beat candidates from the onsets of the music clip, wherein the determining beat candidates includes calculating a beat confidence for each onset by matching the beat pattern template along the onset sequence as $$Conf(n) = \frac{\sum_k O(n+k)P_T(k)}{\sqrt{\sum_k O^2(n+k)\sum_k P_T^2(k)}}$$

wherein Conf(n) is beat confidence at the n-th frame, and PT(k) is the beat pattern template;

estimating a tempo from an onset curve of the music clip;

determining from beat candidates, beat segments having sequential beats with intervals of one or more tempos;

locating synced segments that are synced to an actual beat phase;

locating out-of-sync segments that are out-of-sync with an actual beat phase; and rectifying the out-of-sync segments, wherein the rectifying comprises tracking the out-of-sync segments with the actual beat phase.

4. A method as recited in claim 3, wherein the determining beat segments comprises:

finding at least three sequential beat candidates in a row with intervals of one or more tempos; and confirming the at least three sequential beat candidates as beats that are phase-locked with the music clip.

5. A method as recited in claim 3, wherein the calculating comprises representing a rhythm pattern of the music clip with a beat pattern template and matching the beat pattern template along the onset curve of the music clip.

6. A method as recited in claim 3, wherein detecting beat candidates comprises adaptively setting a threshold and comparing the beat confidence for each onset to the threshold.

7. A computer system comprising:

a buffer containing a music clip;

a valuation module configured to estimate a tempo of the music clip from an onset curve of the music clip, wherein estimating the tempo includes summing onset curves of a lowest sub-band and a highest sub-band to determine the onset curve of the music clip, generating an auto-correlation curve from the onset curve of the music clip, and calculating a maximum common divisor of prominent local peaks of the auto-correlation curve according to the formula $$T = \arg \min_{P_k} \sum_{i=1}^{N} \left| \frac{P_i}{P_k} - \left[ \frac{P_i}{P_k} + 0.5 \right] \right|,$$

wherein $P_k$ are the prominent local peaks;

a beat detection module configured to detect beat candidates from onsets of the music clip and based on a tempo of the music clip;

a rectification module configured to determine segments of beat candidates that are synced with an actual beat phase and to rectify segments of beat candidates that are out-of-sync with the actual beat phase.

8. A computer system as recited in claim 7, further comprising an approximation module configured to estimate a length of a bar of the music clip, wherein the estimating comprises calculating the length as a maximum common divisor of three peaks in the auto-correlation curve if the three peaks are evenly spaced within the tempo of the music clip; and if the three peaks are not evenly spaced within the tempo of the music clip, selecting the position of the maximum peak within the tempo as the length.

9. A computer system as recited in claim 7, further comprising an onset detection module configured to generate the onset curve and detect the onsets from the onset curve.

10. A method comprising:

determining onsets from a music clip;

estimating tempo from an onset curve of the music clip;

determining beat candidates from the onsets;

determining from beat candidates, segments of beat sequences that are synced to an actual beat phase; and rectifying segments of beat sequences that are out-of-sync with the actual beat phase;

wherein the determining onsets from the music clip includes:

down-sampling the music clip into a uniform format;

dividing the music clip into a plurality of non-overlapping temporal frames;

calculating the frequency spectrum of each frame;

dividing each frame into a plurality of octave-based sub-bands;

calculating an amplitude envelope of a lowest sub-band and a highest sub-band;

detecting an onset curve from the amplitude envelope, wherein the onset curve is detected by the formula $O_i(n)=A_i(n)C(n)$, wherein Oi(n) is the onset curve, Ai(n) is the amplitude envelope, and C(n) is a Canny operator that calculates a variance of the amplitude envelope of each sub-band; and determining the onsets as local maximum variances in the amplitude envelope.

11. A method as recited in claim 10, wherein the down-sampling the music clip into a uniform format comprises down-sampling the music clip to a 16 kilohertz, 16 bit, mono-channel sample.

12. A method as recited in claim 10, wherein the dividing the music clip comprises dividing the music clip into a plurality of 16 microsecond-long frames.

13. A method as recited in claim 10, wherein the calculating the frequency spectrum of each frame comprises calculating a fast Fourier transform of each frame.

14. A method as recited in claim 10, wherein the dividing each frame into a plurality of octave-based sub-bands comprises dividing each frame into 6 octave-based sub-bands.

15. A method as recited in claim 10, wherein the calculating an amplitude envelope comprises convolving the lowest sub-band and a highest sub-band with a half raise cosine Hanning window.

16. A method as recited in claim 10, wherein the detecting an onset curve from the amplitude envelope comprises calculating the variance of the amplitude envelope of each of the lowest sub-band and a highest sub-band.

17. A method comprising:

determining beat candidates from onsets of a music clip, wherein beat candidates are determined based on a confidence level, and wherein the onset is detected as a beat candidate when the confidence level is above a certain threshold, the threshold adaptively set based on the formula $$Th_i = a ? \frac{1}{2N} \sum_{n=-N}^{N} Conf(i+n)$$

estimating a tempo of the music clip;

determining from beat candidates, beat segments having sequential beats with intervals of one or more tempos;

locating synced segments that are synced to an actual beat phase;

locating out-of-sync segments that are out-of-sync with an actual beat phase; and rectifying the out-of-sync segments, wherein the rectifying comprises tracking the out-of-sync segments with the actual beat phase.

* * * * *